United States Patent [19]

Eakes

[11] 4,125,062

[45] Nov. 14, 1978

[54] VENTILATING SYSTEM FOR INDUSTRIAL MACHINES

[75] Inventor: Marion L. Eakes, Greensboro, N.C.

[73] Assignee: M. L. Eakes Co., Greensboro, N.C.

[21] Appl. No.: 817,987

[22] Filed: Jul. 22, 1977

Related U.S. Application Data

[63] Continuation-in-part of Ser. No. 683,733, May 6, 1976, Pat. No. 4,050,367.

[51] Int. Cl.[2] ..... F23J 11/00

[52] U.S. Cl. ..... 98/115 LH; 98/36; 55/385 A; 55/DIG. 18; 266/158; 266/159

[58] Field of Search ..... 98/115 R, 115 LH, 36; 126/299 D; 204/247; 202/254, 263; 104/52; 266/158, 159; 55/DIG. 18, DIG. 29, 385 A

[56] References Cited

U.S. PATENT DOCUMENTS

| | | | |
|---|---|---|---|
| 3,303,839 | 2/1967 | Tavan | 126/299 D |
| 3,340,788 | 9/1967 | Landingham et al. | 98/115 LH |
| 3,397,631 | 8/1968 | Simons | 98/36 |
| 3,425,335 | 2/1969 | Black | 98/115 LH |
| 3,800,689 | 4/1974 | Brown | 126/299 D |

*Primary Examiner*—Ronald C. Capossela

[57] ABSTRACT

Contaminated exhaust gases being generated at a work table or work station having one or more open sides adjacent the area above the work table, and normally tending to rise into the atmosphere surrounding the work station, are collected in an exhaust hood which includes an inlet extending parallel to and generally above each of the open sides. A first portion of such exhaust gases collected are passed on to be filtered in conventional pollution abatement equipment; however, a second portion of the contaminated exhaust gases are rerouted, in some cases mixed with fresh outside air, and introduced through an air nozzle directed at the aforementioned inlet to the exhaust hood to improve the exhaust gas collecting, as well as reducing the requisite capacity of the filtration equipment and reducing the intake of make up air from the room surrounding the work table.

1 Claim, 4 Drawing Figures

VENTILATING SYSTEM FOR INDUSTRIAL MACHINES

REFERENCE TO RELATED APPLICATIONS

This application is a continuation-in-part of applicant's copending U.S. application Ser. No. 683,733 filed May 6, 1976, now Pat. No. 4,050,367, issued Sept. 27, 1977.

BACKGROUND OF THE INVENTION

In certain industrial or commercial processes, such as the drawing and crimping of synthetic tow and the like, and in other similar industrial processes, or in such commercial installations as a cooking unit in a restaurant kitchen, a substantial amount of steam, vapors, smoke, and/or oil fumes, hereinafter sometimes referred to as "exhaust gases", are generated. It is, of course, necessary to collect these contaminated gases and not let them escape into the atmosphere of the work room surrounding the machine. It has become commonplace to use an exhaust hood covering such work areas, which exerts a large negative pressure zone at the entrance thereto to draw in large quantities of air and insure collection of all contaminated exhaust gases emitted.

Until recent years, the large intake of contaminated air did not cause any particular problems, because the collected exhaust gases could be passed directly into the exterior air or atmosphere surrounding the industrial plant without control of pollutants. However, with the advent of the environmentalists, and new laws concerning release of contaminated exhaust gases into the atmosphere, it has become necessary to clean all the dirty exhaust gas prior to its introduction into the atmosphere. Such gas separating equipment includes air washers, cyclone separators, scrubbers, mechanical and electrostatic filters, and the like, which are fairly sophisticated and expensive. It is important to note here that the size or capacity of such air cleaning equipment is determined by the amount of air moving therethrough, not by the relative cleanness or contamination of such air. In other words, if it is necessary to withdraw ten thousand cubic feet per minute of air from the work station to insure collection of all exhaust gas emitted at the work station, it makes no difference as to capacity whether the gases withdrawn are contaminated with five parts per million of contaminated particles or one hundred parts per million of contaminated particles. The equipment will clean dirty air as easily as mildly dirty air and must be selected on the basis of the collection of ten thousand cfm, not on the basis of the relative contamination of the air. Therefore, it frequently occurs that expensive pollution abatement equipment may be required to cleanse air that is not relatively dirty.

Further, when large quantities of air are withdrawn from the area above the work table, this air must be replenished in some manner. Resultingly it is the conditioned room air which replaces the air withdrawn in a conventional exhaust hood system. This air must be replenished by similarly conditioned air in the room around the work area.

Also, with negative pressure or suction, it is relatively difficult to collect all of the contaminated exhaust gas emitted some two to three feet below the inlet to the exhaust hood. Some of the exhaust gases are lost through the side opening(s) before reaching the relatively high "capture point", which is the point at which the exhaust gases are sufficiently influenced by the suction from the air inlet of the exhaust hood to insure that they are drawn into the exhaust hood.

SUMMARY OF THE PRESENT INVENTION

The present invention is therefore directed to a ventilating system, and more particularly to an improved exhaust hood overlying an industrial work station with generates contaminated exhaust gases. One of the unique features of the present invention resides in the separating of a portion of the collected exhaust gases prior to their introduction into the pollution abatement equipment. The separated portion of exhaust is returned, either alone or after mixing with a supply of outside air, through an air nozzle closely adjacent to and directed at the air inlet of the exhaust hood. This jet of contaminated air is then immediately taken in by the air inlet, and so affects the negative pressure zone there created as to lower the "capture point" of the contaminated exhaust gases toward the work table below, which improves and enlarges the capture area.

Further, and also importantly, since only a portion of the contaminated exhaust gas is withdrawn or passed directly into the pollution abatement equipment, the capacity requirements of such pollution abatement equipment is thereby accordingly reduced, resulting in both lower initial cost and in lower maintenance costs. Finally, less make-up air is lost as at least a portion of the air entering the exhaust hood is the recirculated contaminated air.

It is therefore an object of the present invention to provide a ventilating system which collects contaminated exhaust gases and emits clean air to the atmosphere with smaller capacity pollution abatement equipment than heretofore known.

It is another object of the present invention to improve the collection of contaminated exhaust gases emitted during certain industrial processes.

Another object of the present invention is to provide a ventilation system for collecting exhaust gases from an industrial or commercial work station with a minimum effect on the atmosphere surrounding the work station.

It is a further object of the present invention to provide a ventilating system of the type described in which, after collection and prior to filtration, a portion of the contaminated exhaust gases are shunted back, sometimes mixed with outside air, and directed toward the inlet of the exhaust hood in the form of an air jet. The capacity of the pollution abatement equipment may be thereby reduced, and the air jet creates a supplementary air path or "Venturi" which improves the contaminated air collecting process.

Other objects and a fuller understanding of the invention will become apparent upon reading the following description of the preferred embodiment of the invention along with the accompanying drawings in which:

FIG. 4 is a sectional view similar to FIGS. 2 and 3, except showing a second alternate embodiment for mixing outside air with.

DETAILED DESCRIPTION OF A PREFERRED EMBODIMENT

Figure 1:
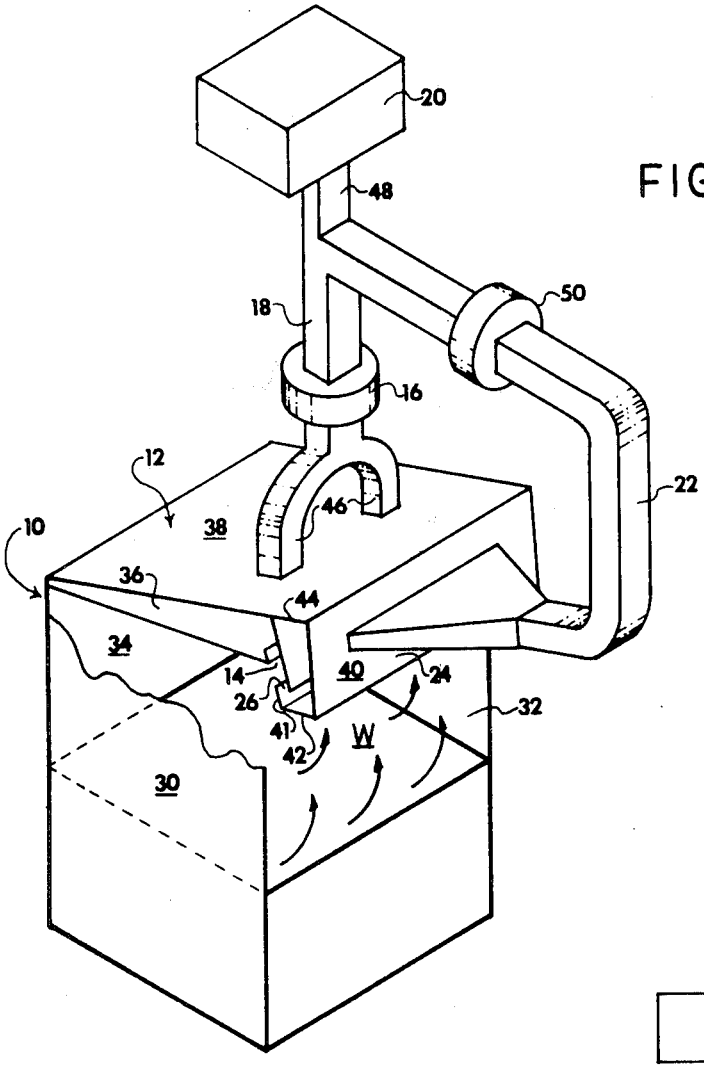
FIG. 1 is a perspective view of a preferred form of the apparatus according to the present invention as installed on a textile apparatus, with the upper portion of the nearest side wall removed for the sake of clarity.

Turning now to the drawings, there is schematically illustrated an industrial or commercial machine comprising a work table W on or at which some type of manufacturing process or on which some commercial operation such as cooking in a restaurant kitchen occurs which generates smoke, steam, fumes, and/or other gaseous vapors which must be collected from the area above work table W before they are allowed to dissipate into the atmosphere surrounding the work area. According to the illustrated embodiment of the machine, the work table is surrounded on three sides and top by a ventilating apparatus 10. An exhaust hood 12 includes an inlet opening 14 in the bottom wall thereof in cooperation with and extending along the front or open side of the area above the work table W. An exhaust fan means 16 draws the exhaust gases from the work area into the hood 12 through the inlet 14 and exhausts such gases to the atmosphere through an exhaust conduit 18 and some suitable type of gas separating means 20.

It should be pointed out here that although, in the preferred embodiment illustrated in FIG. 1, the work table is surrounded on three sides by walls, one or two or all of the three walls of each of the three embodiments may be eliminated leaving merely the exhaust hood 12. In such a case, the exhaust hood would have a corresponding inlet opening 14 along and above each open side of the area above the work table W. Therefore, if all of the side walls were eliminated, the exhaust hood 12 would have four inlet openings, each opening being generally parallel to and spaced above one of the edges of the work table W.

Some type of gas stream separating means 21 is positioned within the first conduit means 18 for dividing the air stream and shunting a prescribed fractional portion thereof into a second or return conduit means 22, which carries the shunted exhaust air back to be directed toward the inlet to the exhaust hood 12. The return exhaust gases enter a plenum 24 from which they are directed toward inlet 14. An air nozzle or slot 26 provides the only exit means for the shunted exhaust gas to leave the plenum 24, and in this regard the air nozzle 26 directs the shunted exhaust gas in a direction toward the initial inlet 14 to the exhaust hood 12.

Turning now to a more specific discussion of the apparatus, the work table W is surrounded by enclosure 10 within which any number of industrial processes might occur, such as the drawing and crimping of synthetic tow for yarn, and other operations which are substantially automatic and which generate substantial amounts of smoke, steam, fumes or other gaseous vapors which must be withdrawn and removed. In the embodiment illustrated in FIGS. 1 and 2, the enclosure 10 is shown to have side and rear walls 30, 32, 34, and a top wall 36. As mentioned hereinabove, although the illustrated embodiment shows side and rear walls 30, 32, and 34, and the invention is also applicable to situations in which there are no side or rear walls, so that the area above the work station could be completely open on all sides with only the exhaust hood 12 thereabove.

The upper exhaust hood 12 utilizes the top wall 36 of enclosure 10 as a base portion or floor thereof and further includes an upper wall 38 extending across the top thereof and outwardly from the front. A front wall 40 depends from the forward edge of upper wall 38, and includes an inturned lower wall segment 42 and an upturned flange 41, which together with an inner wall 44 form a front plenum 24. A return air delivery nozzle in the form of slot 26 extends transversely across the inner side of front plenum 24 in parallel relationship to inlet 14, and directs a jet of air upwardly and inwardly toward the exhaust inlet 14.

A downturned lip 37 depends from the front edge of lower wall 36 and terminates in spaced relation with the upper edge of flange 41 to form slot 26. Upstanding wall 44 extends between the intersection of lip 37 and lower wall 36 and upper wall 38 to separate the front plenum 40 from the main portion of the exhaust hood 12 therebehind. Inlet 14 is so positioned as to extend transverely across the lower wall 36 at a point closely adjacent the vertically extending wall 44 and slightly to the rear thereof. This inlet 14 extends along the upper front edge of the work area above work table W and admits exhaust gases, as well as the jet of air from nozzle 26 into the main portion of the exhaust hood 12. If one or more of sides 30,32 and rear 34 were eliminated, of course, there would be a separate air nozzle 26 and inlet 14 for each side located in correspondingly relative positions to those shown in FIG. 1.

Preferably, a pair of exit ducts 46 extend upwardly from the roof 38 of the exhaust hood 12 and merge into a common duct 18 in which a first fan 16 is placed for the purpose of removing exhaust gases from the work area and passing them on to the pollution abatement equipment 20. After leaving fan 16, there is a separating means 21 in the form of a wall or baffle which extends longitudinally to the air flow path and divides the air stream in conduit 18 into two paths. A first path continues through the conduit branch 48 into the pollution abatement equipment 20. The second branch 22 connects the conduit 18 with the front plenum 24 and delivers a second portion of the dirty exhaust air into the plenum for redistribution through nozzle 26. If desired, a second fan 50 may be placed within conduit 22 to aid in delivering the dirty exhaust air into plenum 24.

Figure 2:
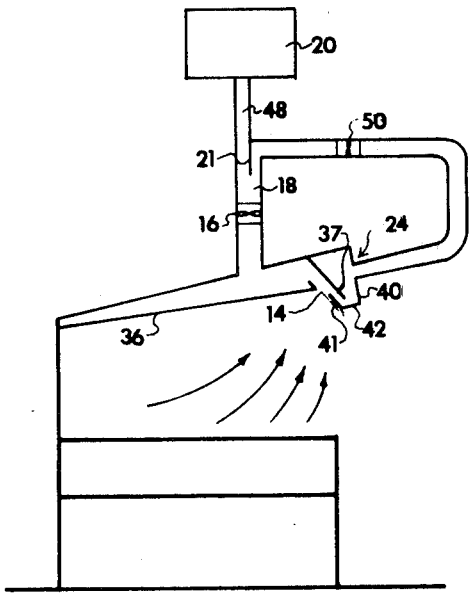
FIG. 2 is a sectional view taken through an apparatus similar to that shown in FIG. 1, and showing schematically the air flow path of the exhaust gases and reintroduced air jet in relation to the apparatus.
Figure 3:
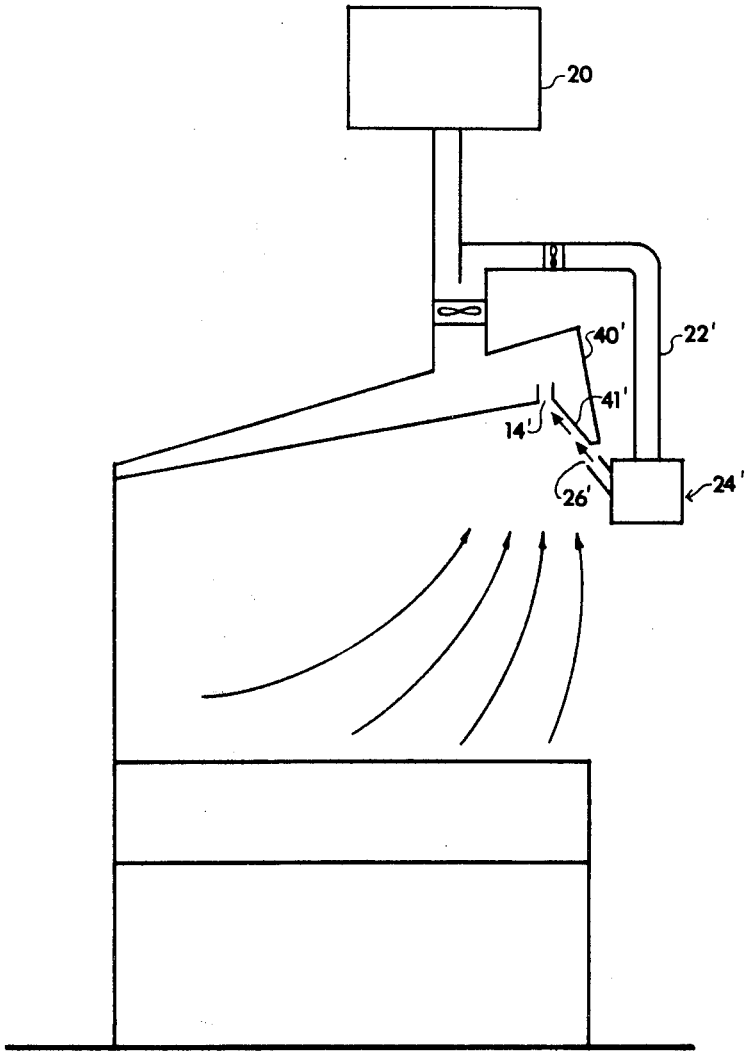
FIG. 3 is a sectional view similar to FIG. 2, except showing a modified arrangement for redirecting a portion of the contaminated exhaust gases toward the inlet.

In the alternate embodiment illustrated in FIG. 3, it is within the scope of the present invention to provide a plenum 24', separate from exhaust hood 12 at a position spaced forwardly from the inlet opening 14' (FIG. 3). In this embodiment the front wall 40' of hood 12' and under portion 41' of the front wall converge downwardly, and plenum 24' is positioned slightly outwardly and downwardly therefrom at the terminum of conduit 22'. The air jet or nozzle 26' is again directed toward inlet 14', but from a slightly greater distance than in FIGS. 1 and 2.

Figure 4:
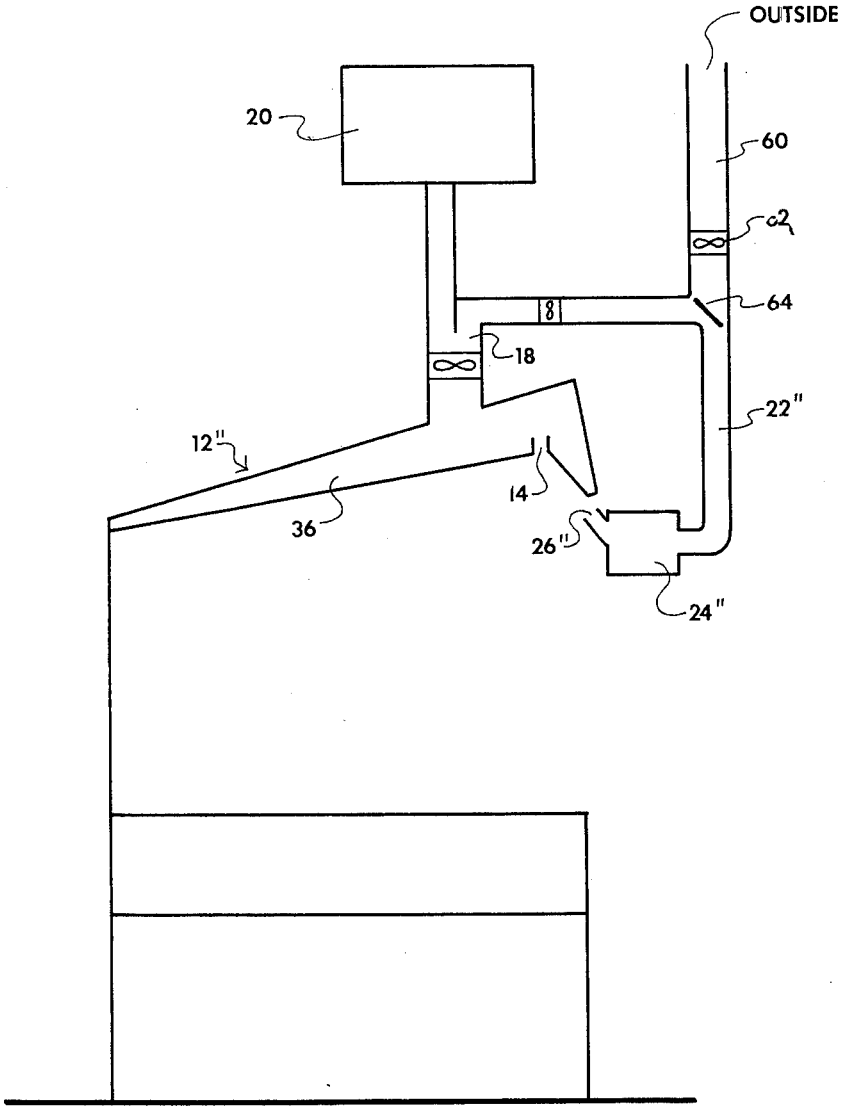

The second alternate embodiment illustrated in FIG. 4 includes a conduit branch 60 leading from the outside into the return conduit 22''. A separate fan 62 and damper 64 are provided with damper 64 being adjusted to mix return air from conduit 18 with fresh outside air for delivery to plenum 24''. This way two additional results may be achieved. First enough air can be introduced through nozzle 26'' to substantially replace the air withdrawn, so that the room air around the work table is substantially unaffected. Secondly, in very cold weather, by mixing some of the exhaust gas with incoming fresh air, condensation on the hood may be eliminated or reduced.

In the embodiments shown in FIGS. 1-3, the duct work is of such relative size and so arranged as to draw off approximately 50% of the contaminated exhaust gases exiting the exhaust hood 12 through conduit 18 for return to front plenum 24. With this return of one-half of the contaminated exhaust gases, the capacity of the pollution abatement equipment 20 can be reduced to approximately one-half the size as would normally be necessary, which is a considerable savings. Also, the cost of providing make-up air to the room surrounding the work area is reduced because less room make-up air is lost. Further, the removal and re-introduction of this portion of contaminated exhaust gas through nozzle 26 has an attendant beneficial effect on the collection of the exhaust gases emitted from below by lowering the "capture point" thereof to a point closer to the work table W.

Although preferred embodiments have been described hereinabove, it is apparent that various changes and modifications can be made to the apparatus disclosed without departing from the scope of the invention, which should be determined by the following claims.

What is claimed is:

1. An improved process for collecting, cleaning up and disposing contaminated exhaust gases generated at a work table comprising the steps of:

(a) collecting the contaminated exhaust gases in an exhaust hood having a longitudinally extending inlet above at least one edge of said work table by applying negative pressure to said inlet thereby entraining said exhaust gases at a capture point below said inlet and above said work table;

(b) directing said collected gases toward a gas separating means between said collecting point and the outside atmosphere;

(c) drawing off a portion of said collected gases upstream of said gas separating means;

(d) mixing a prescribed portion of fresh, untreated outside air with the gases drawn off in step (c);

(e) returning and directing said mixture of outside air and drawn off portion of contaminated gases generally upwardly toward said inlet as an air stream from a nozzle positioned closely adjacent, but slightly downwardly and outwardly from said inlet;

(f) whereby said returned air stream causes the capture point of the contaminated exhaust gases to be lowered, and the capacity of said gas separating means to be reduced.

* * * * *